US009719680B2

(12) United States Patent
Staller

(10) Patent No.: US 9,719,680 B2
(45) Date of Patent: Aug. 1, 2017

(54) PORTABLE, FREE-STANDING EXHAUST SYSTEM

(71) Applicant: Todd Staller, Eutawville, SC (US)

(72) Inventor: Todd Staller, Eutawville, SC (US)

( * ) Notice: Subject to any disclaimer, the term of this patent is extended or adjusted under 35 U.S.C. 154(b) by 652 days.

(21) Appl. No.: 14/268,807

(22) Filed: May 2, 2014

(65) Prior Publication Data

US 2015/0316258 A1 Nov. 5, 2015

(51) Int. Cl.

| | |
|---|---|
| ***E04F 17/02*** | (2006.01) |
| ***F23J 11/00*** | (2006.01) |
| ***F23J 11/08*** | (2006.01) |

(52) U.S. Cl.

CPC ..... *F23J 11/08* (2013.01); *F23J 2213/20* (2013.01); *F23J 2213/203* (2013.01)

(58) Field of Classification Search

CPC .... F23J 11/08; F23J 1/08; F01N 13/08; F01N 2450/10; B08B 15/00; B08B 15/002

USPC ..... 454/1

See application file for complete search history.

(56) References Cited

U.S. PATENT DOCUMENTS 2,733,668 A * 2/1956 Pfetzing ..... B08B 15/002 104/52
3,096,933 A * 7/1963 Bora ..... B08B 15/04 248/186.1
3,480,250 A * 11/1969 Hankins ..... F21S 6/006 248/161
3,941,041 A * 3/1976 Sprout ..... F01N 13/08 104/52
4,505,190 A * 3/1985 Fink ..... B08B 15/026 138/97
4,660,465 A * 4/1987 Jentzsch ..... F16L 41/18 104/52
4,848,310 A * 7/1989 Millington ..... F24C 15/30 126/273 A
5,025,715 A * 6/1991 Sir ..... A47J 33/00 126/30
5,092,228 A * 3/1992 Pfeiffer, Jr. ..... B08B 15/00 104/52
5,362,273 A * 11/1994 Pfeiffer, Jr. ..... B08B 15/002 454/63
5,839,473 A * 11/1998 Caine ..... F01N 13/08 137/527.6
5,911,623 A * 6/1999 Trana ..... B08B 15/002 138/89
6,050,284 A * 4/2000 Caine ..... F01N 13/08 137/15.08
6,306,031 B1 * 10/2001 Hansen ..... B08B 15/002 454/63
6,361,427 B1 * 3/2002 Sjoberg ..... B08B 15/005 454/64

(Continued)

*Primary Examiner* — Steven B McAllister
*Assistant Examiner* — Jonathan Cotov
(74) *Attorney, Agent, or Firm* — Thrive IP®; Jay F. Williams; Jeremy M. Stipkala

(57) ABSTRACT

Devices, systems, and methods for portable, free-standing exhaust systems for exhausting gases from internal combustion type engines, including portable generators. Portable, free-standing exhaust system comprising a plurality of metal exhaust stack sections, forming a continuous hollow column; a housing stand with legs holding the column; a hanger bracket connecting the housing stand and a connector tube, including a separation space, which is connected to an exhaust pipe for exhausting gases.

22 Claims, 6 Drawing Sheets

(56) References Cited

U.S. PATENT DOCUMENTS

| | | | | |
|---|---|---|---|---|
| 6,607,573 | B1 * | 8/2003 | Chaurushia | B01D 46/12 55/356 |
| 7,086,941 | B2 * | 8/2006 | Ennis | B08B 15/00 454/64 |
| 7,273,413 | B2 * | 9/2007 | Frink | B08B 15/002 285/62 |
| 7,550,022 | B2 * | 6/2009 | Smith | B05B 7/2416 118/326 |
| 8,443,792 | B2 * | 5/2013 | Litzenberger | F23J 11/08 126/25 R |
| 9,506,589 | B2 * | 11/2016 | Kramer, Jr. | F16L 33/00 |
| 2010/0163017 | A1 * | 7/2010 | Shepherd | F23J 13/06 126/9 R |
| 2010/0203821 | A1 * | 8/2010 | Crucs | B08B 15/00 454/341 |
| 2012/0218751 | A1 * | 8/2012 | Bacon | F21S 8/086 362/235 |
| 2014/0157778 | A1 * | 6/2014 | Ponnuraj | F01D 25/305 60/694 |

* cited by examiner

PORTABLE, FREE-STANDING EXHAUST SYSTEM

FIELD

The present disclosure relates generally to portable, free-standing exhaust systems for exhausting gases from internal combustion type engines, including portable generators.

BACKGROUND

Citation of any document herein is not intended as an admission that such document is pertinent prior art, or considered material to the patentability of any claim of the present application. Any statement as to content or a date of any document is based on the information available to applicant at the time of filing and does not constitute an admission as to the correctness of such a statement.

People use electrical generators, including those with internal combustion engines (e.g., gasoline, diesel, propane, etc.), to supply electrical power to their home, recreational vehicle (RV)/motor home often while at a camp-site, a party, or a tail-gait, or to supply power at a work-site. Conventional generators are often contained beneath the motor home or RV or otherwise positioned nearby on the ground and have an exhaust system near ground level. While such generators produce electricity, they generate a lot of noise and they create and discharge exhaust fumes, including noxious gases and carbon monoxide, beneath the motor home or RV or otherwise at or near ground level. The exhaust fumes are a nuisance, and they present a health hazard to nearby persons, as the fumes are discharged at or near ground level. Conventional motor home/RV auxiliary exhaust systems in the past are made of metal and become very hot and can easily burn a child or adult who accidently touches the exhaust stack while in operation. These prior metal exhaust systems are also expensive, heavy, and difficult to assemble, disassemble, remove, store and transport. Other prior exhaust systems sing plastic hoses and/or stack sections can also become very hot and can burn those who accidentally touch them.

SUMMARY

The present disclosure provides for devices, systems, and methods related to portable, free-standing exhaust systems for exhausting gases from internal combustion type engines, including portable generators. In one embodiment, the portable, free-standing exhaust system comprises: (i) a plurality of metal exhaust stack sections, slidably joined and in fluid communication, one to another, to form a continuous hollow column having an upper end and a lower end; (ii) a stand comprising a housing having a top and a bottom, an interior channel connecting an opening on the top to an opening on the bottom, the top opening configured to receive internally the lower end of the column and support the column in an upright vertical position, and a plurality of legs attached to the exterior of the housing; (iii) a hanger bracket fixed to the housing and extending below the bottom opening; (iv) a connector tube having a first end adapted to collect exhaust gases from one or more exhaust pipes on one or more generators, and a second end releasably secured to the hanger bracket to have a separation space between the second connector tube end and the bottom opening; (v) the system being configured so the exhaust gases from the one or more exhaust pipes flow into and through the connector tube and exit the second connector tube end and into and through the separation space and into the bottom opening and through the channel to the vertical hollow exhaust column for cooling and exhaustion from the upper end, and the exhaust gases flowing into the bottom opening create a vacuum drawing ambient air into the separation space and into the bottom opening to mix with and cool the exhaust gases; and (vi) the outer surface of each exhaust stack section is configured to have a larger exterior surface area for displacing heat.

These and other features, aspects, and advantages of the subject matter of this application will become better understood with regard to the following description, appended claims, and accompanying drawings.

DETAILED DESCRIPTION

Figure 1:
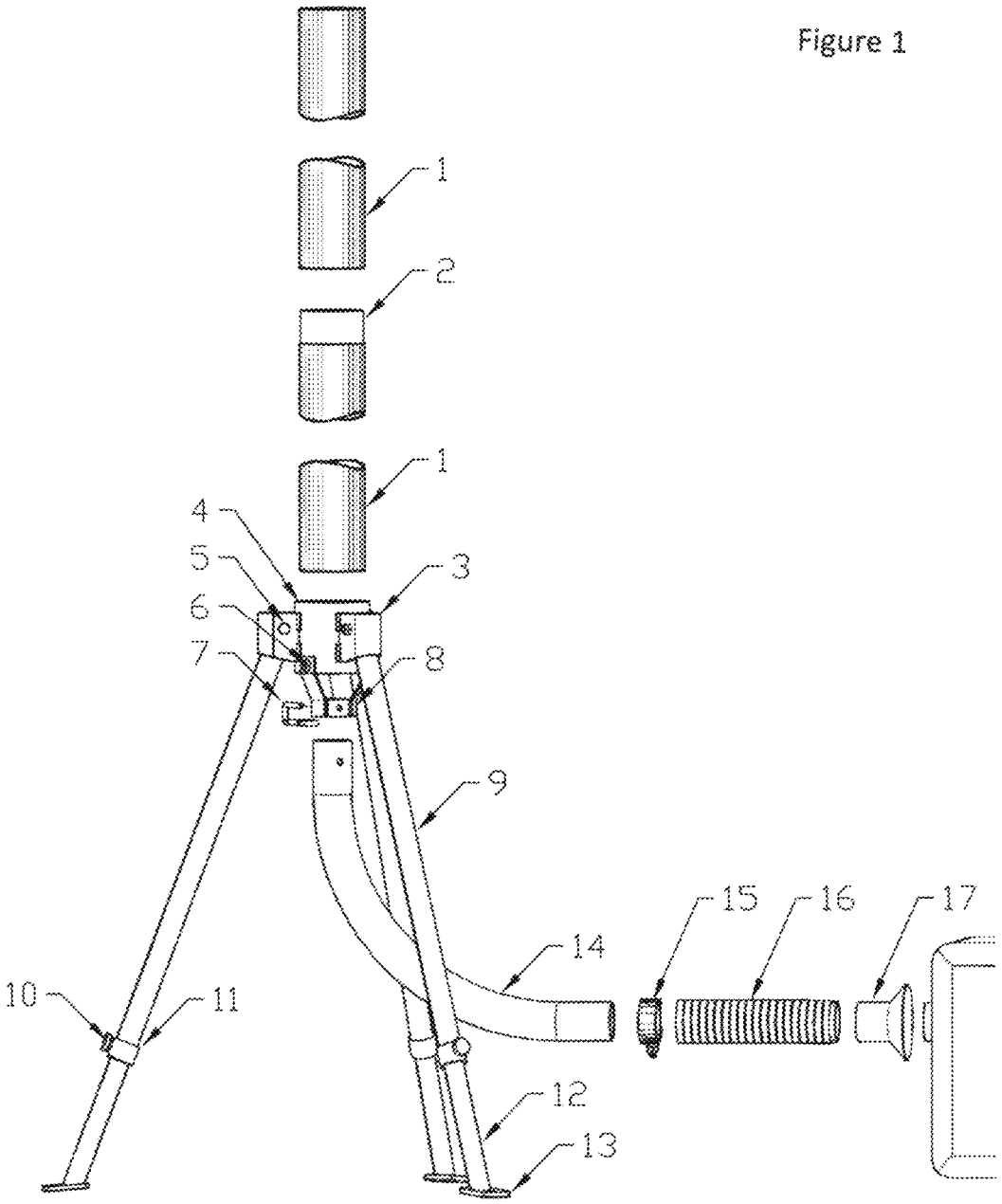
FIG. 1 is a perspective, pictorial representation of one embodiment of the portable, free-standing exhaust system connected to a portable generator. The connector tube is a curved hollow pipe, which may be optionally secured, by way of a clamp, to one end of a flexible tube, and the other end of the flexible tube is attached to a flared nipple for collecting exhaust gases from the portable generator.

Detailed descriptions of one or more embodiments are provided herein with reference to the accompanying drawings, in which the embodiments are shown. It is to be understood, however, that the devices, systems and methods according to this disclosure may be embodied in various forms. Therefore, specific details disclosed herein are not to be interpreted as limiting, but rather as a representative basis for the claims and for teaching one skilled in the art to employ the present devices, systems and methods in any appropriate manner. Accordingly, the present devices, systems and methods of the disclosure may be embodied in many different forms and should not be construed as being limited to the embodiments set forth herein; rather, the embodiments are provided so that this disclosure will be thorough and complete, and will fully convey the concept of the disclosure to one skilled in the art.

Where ever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" or "approximately" is meant to account for variations due to experimental error. All measurements or numbers are implicitly understood to be modified by the word about, even if the measurement or number is not explicitly modified by the word about.

The terms "comprising" and "including" and "having" and "involving" and the like are used interchangeably and have the same meaning. Similarly, "comprises", "includes," "has," and "involves" and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Where ever the terms "a" or "an" are used, "one or more" is understood unless explicitly stated otherwise or such interpretation is nonsensical in context.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "on" versus "directly on", "between" versus "directly between", "adjacent" versus "directly adjacent", etc.).

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

The present disclosure provides for devices, systems, and methods for portable, free-standing exhaust systems for exhausting gases from internal combustion type generators, including portable generators and/or fixed generators associated with a recreational vehicle, camper, motor home, house, or building, including portable generators.

In a first main embodiment, the portable, free-standing exhaust system comprises: (i) a plurality of metal exhaust stack sections, slidably joined and in fluid communication, one to another, to form a continuous hollow column having an upper end and a lower end; (ii) a stand comprising a housing having a top and a bottom, an interior channel connecting an opening on the top to an opening on the bottom, the top opening configured to receive internally the lower end of the column and support the column in an upright vertical position, and a plurality of legs attached to the exterior of the housing; (iii) a hanger bracket fixed to the housing and extending below the bottom opening; (iv) a connector tube having a first end adapted to collect exhaust gases from one or more exhaust pipes on one or more generators or engines, and a second end releasably secured to the hanger bracket to have a separation space between the second connector tube end and the bottom opening of the housing; (v) wherein the system is configured so the exhaust gases from the one or more exhaust pipes flow into and through the connector tube and into and through the separation space and into the bottom opening of the housing in such a manner as to form a vacuum drawing ambient air into the separation space to mix with and cool the exhaust gases as they flow through the channel and into and through the continuous hollow column for cooling and exhaustion from the upper end of the continuous hollow column; and each exhaust stack section has variations on its outer surface that increase the outer circumferential surface area of each exhaust stack section to displace heat faster.

In general, each exhaust stack section is made from metal formed into a rigid, hollow, tube/pipe-like or duct-like housing having an upper end and a lower end with openings on each end. The exhaust stack sections are rigid metal tubes that hold a specific cross-sectional shape. The shapes include circular (such as cylindrical tube), oval, rectangular, square, hexagon, pentagon, octagon, triangular, and many other additional custom shapes, so long as each section is stackable, one on top of the other and are strong enough to support many sections stacked above it. In this manner, individual stack sections are configured to be slidably joined and in fluid communication with adjoining stack sections positioned above and below it, so the sections can be stacked one on top of the other to a desired height to form a continuous hollow column tall enough to carry exhaust gases up and over recreational areas, living and/or work spaces. Each stack section has a fitted, internal sleeve at one end, which may be inserted into the hollow cavity in the opposite end of an adjoining stack section stacked on top or below. For instance, each metal exhaust stack section is a circular metal tube having a fitted, internal sleeve extending from one end, the diameter of which is slightly smaller than the interior diameter of the remainder of the exhaust stack section, so the sleeve can slide into the interior cavity of an adjoining stack section positioned above or below it to thereby hold it in place and allow each section to stack one on top of the other to form the continuous hollow column. As many stack sections as needed can be added to extend the continuous hollow column to a desired height to prevent nearby persons from breathing the exhaust fumes.

In general, the metal stack sections of the exhaust system are rigid, strong, light weight, have low heat retention and are non-combustible. The stack sections are rigid and strong enough not to bend or collapse, when stacked together to form the vertical exhaust column. The stack sections are light enough, so the column can be assembled and taken apart, stored and transported with relative ease when not in use. The stack sections are formed from various metals, including aluminum, brass, carbon steel, spring steel, mild steel, stainless or galvanized steel, copper, nickel, bronze, titanium, zinc, iron and/or other metal alloys. In one embodiment, each stack section is a cylindrical aluminum tube, which is strong, light weight, has low heat retention, and is non-combustible.

The length, wall thickness, and diameter or cross-sectional measurement of individual stack sections and other tubes used in the exhaust system vary so long as they function as described herein. In one embodiment, for example, a circular/cylindrical tube, the diameter measuring from outside wall to outside wall (outside diameter (OD) is generally in a range selected from about 2.0, 2.25, 2.5, 2.75, 3.0, 3.25, 3.5, 3.75, 4.0, 4.25, 4.5, 4.75, 5.0, 5.25, 5.5, 5.75, and 6.0 inches, and in one embodiment, it is the range of approximately 3.0 to 4.0 inches, and in another embodiment it is approximately 3.0 inches.

The length of individual stack sections or other tubes used in the exhaust system varies so long as they function as described herein. In one embodiment, the length is in a range selected from approximately 3.0 to 60.0 inches, and is generally in a range selected from about 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, and 60 inches. This range includes at least fractional variations of about ¼ inch, ½ inch, and % inch of these length measurements. In one embodiment, for example, the length of each stack section is generally in a range selected from approximately 24 to 60 inches, and is generally in a range selected from about 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, and 60 inches. This range includes at least fractional variations of about ¼ inch, ½ inch, and % inch of these length measurements. In one embodiment, the length of each stack section is 46 inches. In another embodiment, each stack section is approximately 1.0 m (or 39.37 inches) in length. The length of support tubes, connector tubes, and adaptor tubes can also vary along these lines, and the flexible metal tube for the RV model of the exhaust system may be considerably longer as described further below.

The wall thickness of individual stack sections or other tubes used in the exhaust system also vary so long as they function as described herein. For example, in one embodiment, the wall thickness of each stack section ranges from about 0.031 to 0.125 inches. In another embodiment, the wall thickness of each stack section is about 0.074 inches. In one embodiment, the wall thickness of the flexible tube and/or the connector tube ranges from about 0.012 to 0.625 inches. In another embodiment, the wall thickness of each flexible tube and/or connector tube is about 0.012 inches.

The exterior surface of each stack section is either smooth or in one embodiment, it is configured to include variations thereon so that the outer surface area is relatively larger as compared to a smooth outer surface. For instance, in one embodiment, each exhaust stack section has variations on its outer surface that increase the outer circumferential surface area of each exhaust stack section to displace heat faster. The enlarged surface area displaces heat faster, as compared to a smooth outer surface, and thereby reduces surface temperatures on the exterior of the column so the column does not become hot enough to burn people or property. For example, the outer surface of each stack sections may be grooved, serrated, ribbed, fluted/scalloped, and/or notched. In one embodiment, each stack section is a cylindrical aluminum tube in which the exterior surface is grooved, ribbed, serrated, fluted/scalloped, and/or notched. In a further embodiment, the exterior of each stack section is painted and/or coated to make it more aesthetically pleasing, while not detracting from the ability to displace heat.

In a further embodiment, the uppermost stack section at the top of the exhaust column may be fitted with a metal cap positioned above the opening to deflect rain, but still allow exhaust gases to exit.

The stand of the exhaust system includes a formed metal housing with a plurality of legs attached to the exterior of the housing. The housing has a top and a bottom and an interior hollow channel connecting an opening on the top to an opening on the bottom. The top opening of the housing is configured to receive internally and hold the bottom-most metal exhaust stack section (at the lower end of the vertical exhaust column) in a manner so as to support the continuous hollow column in an upright vertical position. The shape and dimensions/sizing of the housing and/or the top opening and the interior hollow channel will generally correspond to the shape and size of the stack sections as described herein. In this manner, the top opening and the interior hollow channel are sized and configured to receive internally the lower most stack section and to support the continuous hollow exhaust column in an upright vertical position. The metal used to make the housing and legs will also generally correspond to that used to make the stack sections. The dimensions of the housing and the legs may be selected from the ranges given above for the stack sections.

The legs are attached to the exterior of the housing in a manner to allow the legs to collapse for easy storage and transport. In one embodiment, each leg is to the attached to the housing by way of a hinge or a formed folding leg pocket with through holes to fasten each collapsible leg in place with a bolt and nut, wherein each leg pocket is welded to the housing. In on embodiment, each leg is made from aluminum and is adjustable in that it can be raised or lowered to a desired height to make it easy to assembly the exhaust system on uneven terrain nearby and/or over a generator. In this regard, each adjustable leg has an upper leg section and a lower leg section, wherein the upper leg section is a hollow tube having an interior cavity with a diameter greater than the outside diameter of the lower leg section. In this manner, the lower leg section is insertable into and slides up and down inside the hollow cavity of the upper leg section. When adjusted to a desired height, the lower leg section is releasably secured to the upper leg portion, for example, by way of a welded aluminum reinforcement collar, which is threaded to receive thumb screws for tightening. By sliding the lower leg section up or down inside the upper leg section, one may adjust the stand to a desired height to provide greater stability, especially when set up on uneven terrain. In this manner, the exhaust system is portable and free-standing so that it can be easily assembled at a campsite, living space, recreational space, or work space with ease. It can be positioned near/next to, or at a distance from, or on the side of, or overtop a generator or exhaust pipe of an RV.

In a further embodiment, flat platform/feet are attached to the bottom of each lower leg section to provide greater stability. In a further embodiment, the feet are equipped with holes for releasably anchoring/staking the legs to the ground to prevent the stack from being knocked over or moved. Alternatively, on hard surfaces, such as asphalt or concrete, weighted bags are attached to the tripod stand to keep it from being knocked over.

The exhaust system further includes a metal hanger bracket fixed to the exterior of the housing on the stand and extending below the bottom opening of the housing. The hanger bracket may be made from a variety of metals or metal alloys, including aluminum, brass, carbon steel, spring steel, mild steel, stainless or galvanized steel, copper, nickel, bronze, titanium, zinc, iron and/or other metal alloys. The hanger bracket is configured to releasably attach to one end of a connector tube that inserts into the hanger bracket and is secured thereto by way of pin that fits throw holes in the hanger bracket that align with holes in the second connector tube end. In one embodiment, the hanger bracket. In one embodiment, the hanger bracket is galvanized steel or stainless steel and is secured to the housing by pop rivets. In this embodiment, when the system is assembled, the bottom-most exhaust stack section on the lower end of the column inserts into the opening to the channel on the top end of the stand housing and rests on the pop rivets protruding into the channel housing (the pop rivets being used to fasten the hanger bracket to the housing). In this manner, the channel walls and the pop rivets support the continuous hollow column in an upright vertical position.

The stand housing and legs must be strong, light weight, have low heat retention, and be non-combustible. They are made from various metals, including aluminum, brass, carbon steel, spring steel, mild steel, stainless steel, galvanized steel, copper, nickel, titanium, zinc, iron and/or other metal alloys. In one embodiment, the stand has an aluminum tripod body formed into a cylindrical tube housing having three adjustable aluminum legs each attached to the exterior of the housing by an aluminum leg pocket and a bolt.

The connector tube has a first end adapted to collect exhaust gases from one or more exhaust pipes on one or more generators, and a second end releasably secured to the hanger bracket in a manner to have a separation space between the second connector tube end and the bottom opening on the housing. In this manner, the system is configured so exhaust gases from the one or more exhaust pipes flow into and through the first connector tube end, exiting the second connector tube end and flowing into and through the separation space and into the bottom opening of the housing and through the channel in the housing and into and through the vertical hollow exhaust column for cooling and exhaustion from the upper end.

The exhaust system is configured so that exhaust gases flowing through the separation space and into the bottom opening of the housing create a vacuum drawing ambient air into the separation space and into the bottom opening of the housing to mix with and cool the exhaust gases as they continue to travel through the housing and into and through the upright vertical continuous hollow column. This mixing of the outside ambient air with the exhaust gases reduces the heat of the gases, which in turn reduces the surface temperature on the outside of the vertical exhaust column so the column does not become hot enough to burn people or property. The distance (forming the separation space) between the second connector tube end and the bottom opening is approximately 0.25 to 2.25 inches. For example, the distance between the second connector tube end and the bottom opening is selected from the group consisting of about 0.25, 0.5, 0.75, 1.0, 1.25, 1.5, 1.75, 2.0, and 2.25 inches. In one embodiment, the separation is approximately 1.0 inch.

The connector tube is a metal tube/pipe, which is strong, light weight, has low heat retention and is non-combustible. In general, the connector tube is made from flexible metal tubing, a straight metal tube/pipe, an angled or bent metal tube/pipe, an L-shaped metal tube/pipe, or a curved metal tube/pipe. The connector tube may be flexible, bendable, collapsible/expandable tubing or rigid. The connector tube is generally made from aluminum or steel, e.g., stainless or galvanized steel. In general, the type of metal used to make the connector tube and the shape, size and dimension of the connector tube may be selected from those previously mentioned above for the stack sections. In one embodiment, the connector tube is made from stainless steel. In another embodiment, it is made from aluminum. In one embodiment, the connector tube is a steel or galvanized stainless steel tube/pipe configured so the first connector tube end is positioned 90° relative to the second connector tube end.

In one embodiment, the connector tube end not secured to the hanger bracket attaches directly or indirectly to the one or more exhaust pipes. In another embodiment, the connector tube end (not secured to the hanger bracket) is fitted with a flared nipple to collect exhaust gases exiting the exhaust pipe of the generator or engine. The flared nipple is positioned next to the exhaust pipe or it may be releasably attached directly or indirectly to the exhaust pipe. In another embodiment, the first connector tube end is releasably attached (by a metal clamp, such as a band clamp) to one end of a flexible metal tube and the other end of the flexible tube is fitted with the flared nipple, which in turn is attached directly or indirectly to the exhaust pipe. In this manner, the exhaust system may be positioned next to the exhaust muffler or generator exhaust pipe, or it may be positioned at a distance therefrom, in which case, the flexible metal tube connects to the system to the exhaust pipe. Accordingly, the flexible metal tube may be of any desired length (and may be considerably longer than the lengths disclosed above for the exhaust stack section), so long as it connects the exhaust system to the muffler/exhaust pipe, so that the system achieves the desired objective of removing exhaust fumes and reducing noise.

In one embodiment, each exhaust stack section is a cylindrical ribbed aluminum tube, having a top, a bottom, and a fitted sleeve extending from the top configured to slide into the bottom of another exhaust stack section positioned above it; the housing has an aluminum tube tripod body with three adjustable aluminum legs and a top opening and a bottom opening, the top opening configured to receive internally the lower end of the column and support the column in an upright vertical position; the connector tube is a steel pipe with a 90° bend, the first connector tube end has a flared nipple attached to it, and the second connector tube end is configured to insert into and be secured to the hanger bracket by a pin; and the separation space is about 1.0 inch.

Referring now to the Figures, wherein like reference numerals refer to like parts throughout, FIG. 1 is a perspective, pictorial representation of the first main embodiment of the portable, free-standing exhaust system, which exhausts gases from a portable generator. In FIG. 1, each metal exhaust stack section 1 is a cylindrical tube having a serrated/ribbed exterior surface and a fitted, internal sleeve 2 extending from the top, the diameter of which is less than the interior diameter of the remainder of the exhaust stack section, and is configured so that sleeve 2 slides into the bottom of an exhaust stack section positioned above it to thereby hold it in place and allow each section to stack one on top of the other to thereby form the continuous hollow column.

In FIG. 1, the tripod stand has a cylindrical tube housing 4 with three adjustable legs 9, each attached to the exterior of the housing by bolt 5 in leg pocket 3, which is welded onto the exterior of the housing. Each adjustable leg has an upper leg section 9 and a lower leg section 12. Upper leg section 9 is a hollow tube having an interior cavity diameter greater than the outside diameter of lower leg section 12, so lower leg section 12 can insert into and slide up and down inside the hollow cavity of upper leg section 9 to adjust the stand to a desired height. Lower leg section 12 is releasably secured to upper leg portion 9 by welded aluminum reinforcement collar 11, which is threaded to receive thumb screws 10, which can be tightened and untightened. Feet 13 are attached to the bottom of each lower leg section 12 for added stability.

In FIG. 1, metal (e.g., aluminum) hanger bracket 8 is secured to housing 4 by aluminum pop rivets 6 and is configured to releasably secure to and hold, by way of pin 7, connector tube 14 in a manner to create a separation space shown between the bottom of housing 4 and the first end of the connector tube. In FIG. 1, connector tube 14 is a curved, hollow tube/pipe, configured so the first connector tube end is positioned 90° relative to the second connector tube end, and connector tube 14 is secured, by way of metal clamp 15, to one end of flexible tube 16, and the other end of flexible tube 16 is attached to a flared nipple 17 for collecting exhaust gases from a generator.

Figure 2:
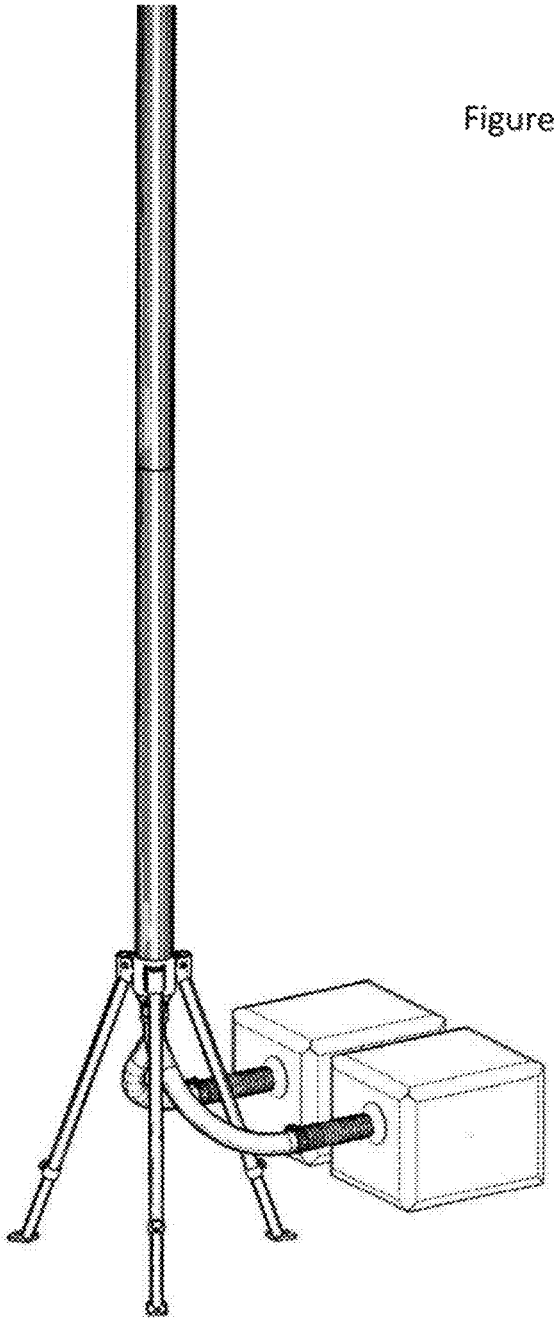
FIG. 2 illustrates an embodiment of the exhaust system of FIG. 1, in which the connector tube is a Y-shaped curved pipe having two ends adapted to collect exhaust gases from two generators.
Figure 3:
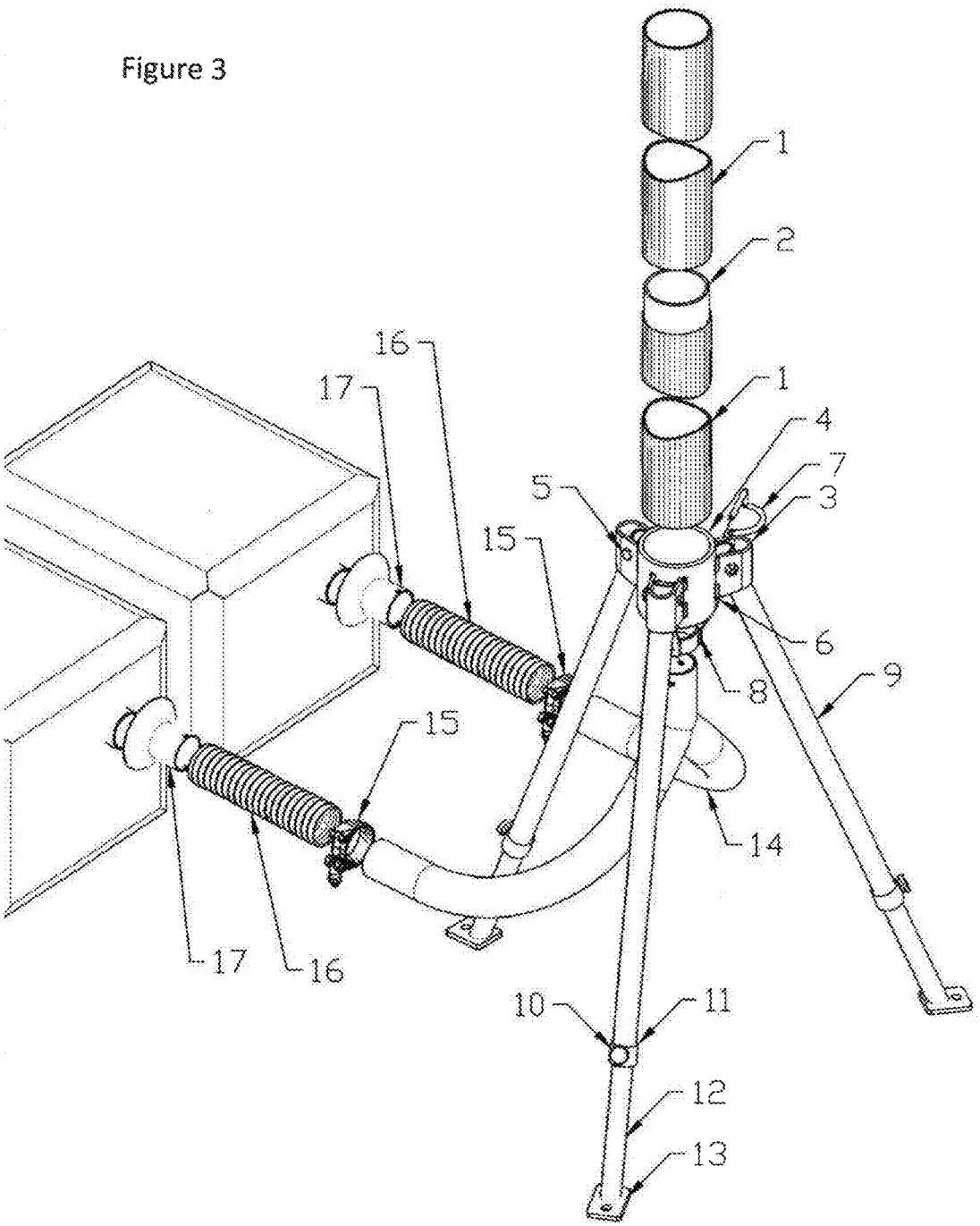
FIG. 3 is a close-up depiction of the embodiment of FIG. 2, in which the connector tube is a Y-shaped curved pipe having two ends adapted to collect exhaust gases from two generators.

Another main embodiment of the exhaust system is similar to the main embodiment described above except the curved shaped connector tube is configured so the first connector tube end is split into two (or more) separate ends to form a Y-shaped curved pipe), each end adapted to collect exhaust gases from an exhaust pipe on a generator. FIGS. 2 and 3 depict this further embodiment of the system of FIG. 1, in which connector tube 14 is configured so the first end of connector tube 14 is split into two separate ends (to form a Y-shaped curved pipe), each end adapted to collect exhaust gases from an exhaust pipe on a generator. In this regard, in FIGS. 2 and 3, connector tube 14 is shown as a Y-shaped tube/pipe for attaching to two generators, wherein the split first connector tube ends are positioned 90° relative to the second connector tube end. In FIG. 3, the second connector tube end is attached to hanger bracket 8 by pin 7. In FIG. 3, the split first connector tube ends of connector tube 14 are secured, by way of metal clamps 15, to one end of flexible tubes 16, and the other end of flexible tubes 16 are attached to flared nipples 17 for collecting exhaust gases from a generator.

In a further main embodiment, the portable, free-standing exhaust system is used with a recreational vehicle (RV). The design for the RV application reflects the same construction as the portable generator model described above, except it has taller legs and instead of the 90° bent pipe as the connector tube it utilizes a flexible metal (such as aluminum) tube attached to one or more metal support tubes and one or more metal adaptors that further attach to an exhaust pipe/muffler. In this embodiment, at least two metal support tubes are used which attach to opposite ends of a flexible metal tube. The metal support tubes are straight, rigid, hollow metal tubes and are made from the same metals described above for the connector tube. In one embodiment, the metal support tubes are rigid stainless steel or galvanized steel tubes. One end of a first metal support tube is attached to the hanger bracket by way of a pin that goes through two aligned holes on opposite sides of the hanger bracket, which holes are aligned with two holes on opposite walls at the end of the metal support tube. The other end of the first metal support tube slides inside one end of the flexible metal tube and is secured thereto by way of a clamp, such as a band clamp. The other end of the flexible metal tube attaches in a similar manner to a second metal support tube, i.e., one end of the second metal support tube slides inside the flexible metal tube and is then attached by a clamp. The other end of the second metal support tube is then inserted into one end of the metal adaptor tube and secured thereto by way of a pin that is inserted through two aligned holes in the same manner described. In particular, the metal support tube has two aligned holes on opposite walls, which when it is inserted in the metal adaptor tube, align with two holes on opposite walls of the metal adaptor tube. In this regard, the outer diameter of the metal support tube is smaller than the interior diameters of the flexible metal tube and the metal adaptor tube. The other end of the metal adaptor tube slides over and is clamped onto the exhaust pipe by way of an exhaust clamp. The metal support tube and the metal adaptor are rigid, steel tubes.

In this embodiment, the exhaust system may be positioned next to the exhaust muffler or generator exhaust pipe, or it may be positioned at a distance therefrom. The flexible metal tube may be of any desired length (and may be considerably longer than the lengths disclosed above for the exhaust stack section), so long as it connects the exhaust system to the muffler/exhaust pipe, and the system achieves the desired objective of removing exhaust fumes and reducing noise.

Figure 4:
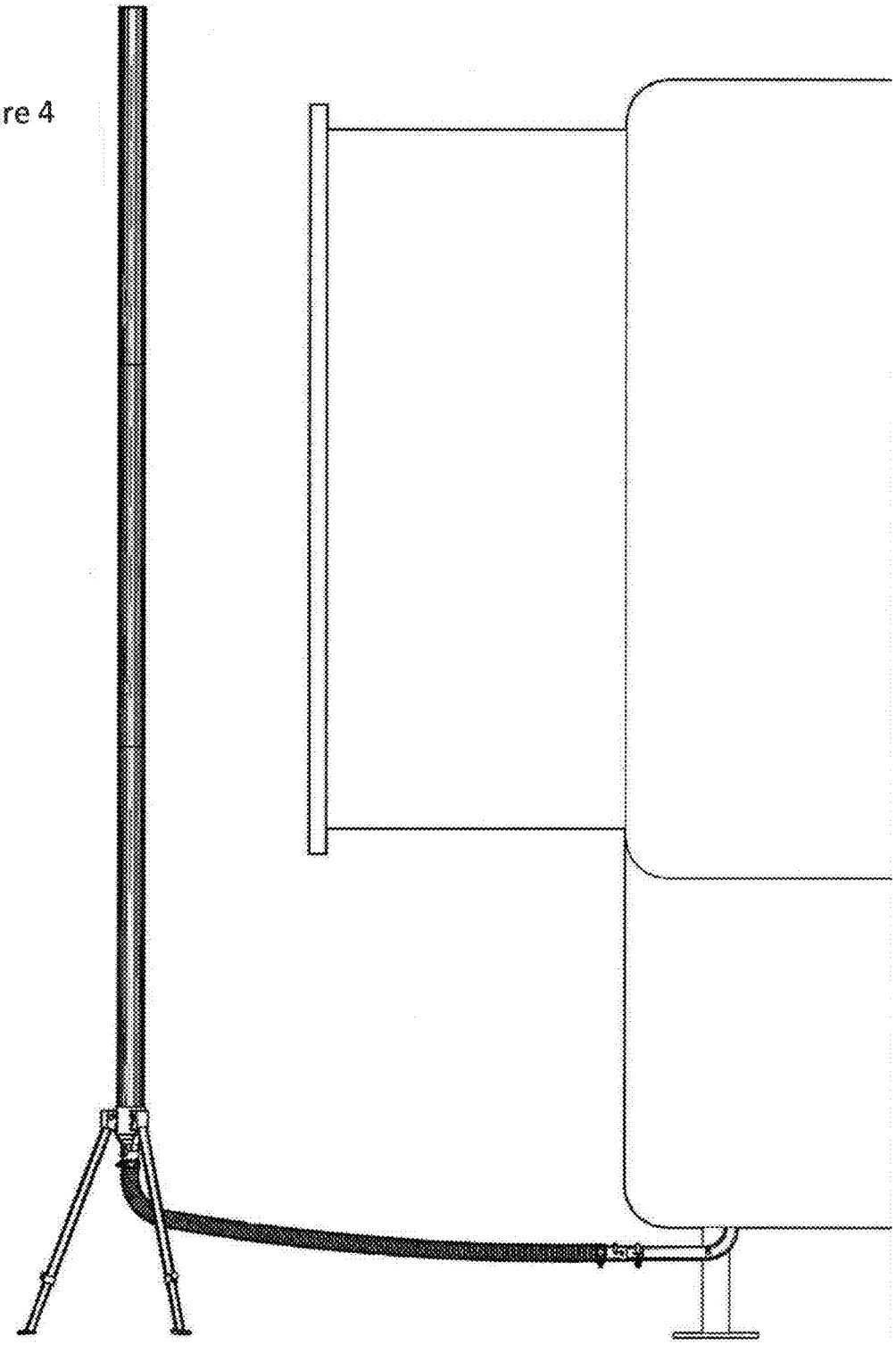
FIG. 4 illustrates an embodiment of the portable, free-standing exhaust system connected to a muffler/tail pipe of a recreational vehicle (RV). The connector tube is a flexible hollow tube and is connected to the exhaust tail pipe/muffler of the RV, and the exhaust stack sections form a stack tall enough to carry exhaust gases up and over the RV.
Figure 5:
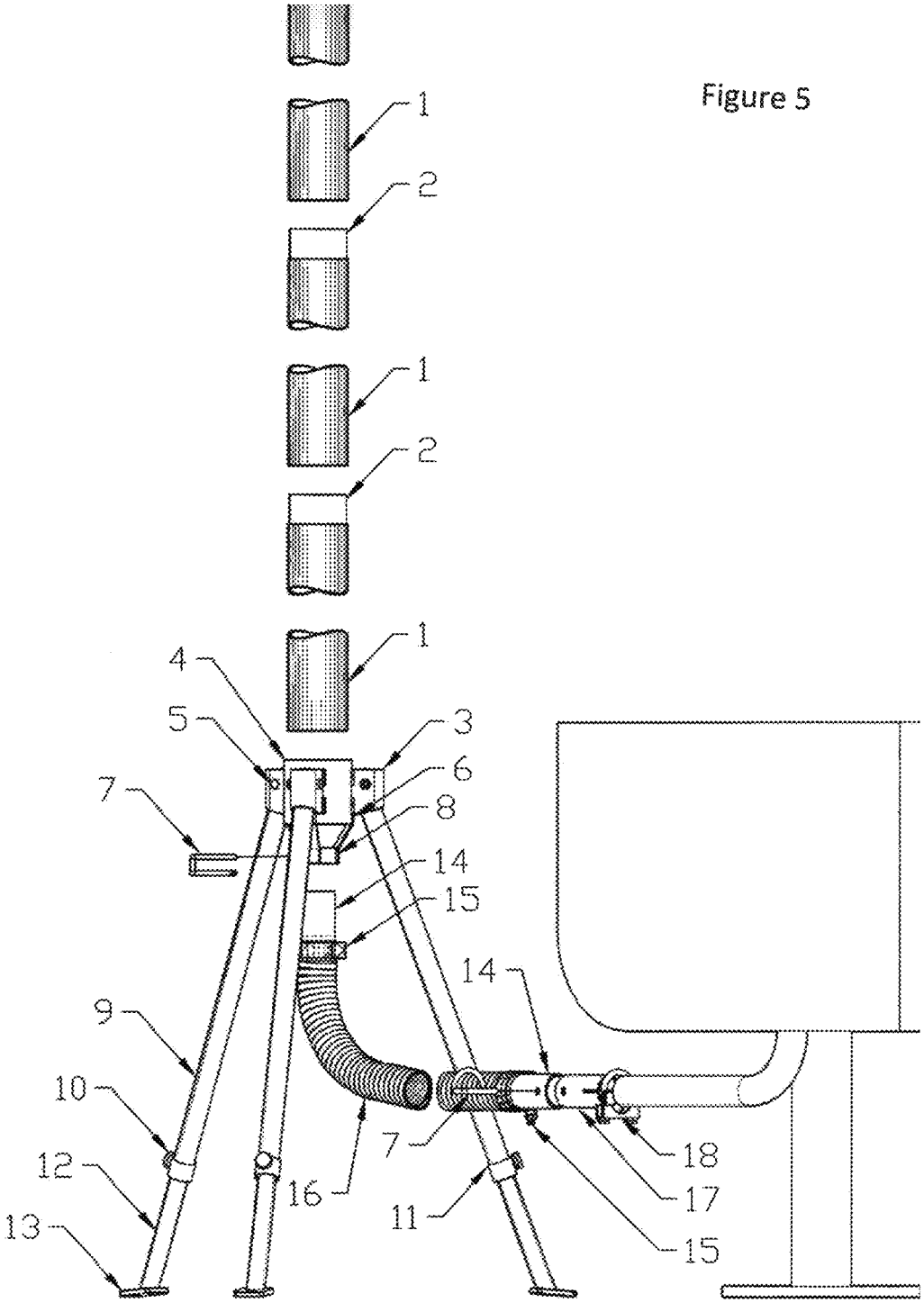
FIG. 5 is a close-up, exploded view of the embodiment of FIG. 4, showing the various component parts thereof.

FIGS. 4 and 5 illustrate this other main embodiment of the portable, free-standing exhaust system in which the system is connected to an RV, and in which the curved shaped connector tube 14 of FIG. 1 is replaced with a flexible metal tube, one or more metal support tubes adaptors, and one or more metal adaptor tubes. One end of the first metal support tube 14 is attached to hanger bracket 8, by way of pin 7 that goes through two holes in the hanger bracket that are aligned with two holes on opposite walls of one end of the support tube 14. The other end of first metal support tube is attached to the long flexible metal tube 16 by clamp 15. The other end of the long flexible tube 16 is attached to a second metal support tube 14 by a second clamp 15. The other end of the second metal support 14 slides into a rigid metal adaptor tube 17, which has two holes on opposite walls and is secured thereto by a second pin 7 that goes through two holes in the adapter that are aligned with two holes on rigid support tube. The metal adaptor is secured to the exhaust tail pipe of an RV by exhaust clamp 18. FIG. 4 further depicts the exhaust system positioned at a distance from the exhaust pipe of the RV, and is connected to the RV exhaust pipe by the long flexible hollow metal tube 16. FIG. 4 further depicts the exhaust stack sections forming a stack tall enough to carry exhaust gases up and over the RV. In this manner, the system removes exhaust and reduces noise.

Accordingly, the embodiments described above encompass methods of exhausting gases from one or more generators or engines. The methods comprise: attaching a plurality of exhaust stack sections to each other so the stack sections are slidably joined and in fluid communication, one to another, to form a continuous hollow exhaust column having an upper end with an opening and a lower end with an opening; attaching the continuous hollow exhaust column to a metal stand having a housing with a top, a bottom, an interior channel connecting an opening on the top to an opening on the bottom, and three or more legs attached to the exterior of the housing that support the housing in an upright vertical position, wherein the lower end of the continuous hollow exhaust column is inserted into the top opening of the housing and supported by the housing in an upright vertical position; attaching a metal connector tube to a hanger bracket fixed to the housing and extending below the bottom opening of the housing in such a manner to form a separation space between the connector tube and the bottom opening of the housing; attaching the other end of the metal connector tube to an exhaust pipe from one or more generators or engines; and venting exhaust gases from the exhaust pipe through the connector tube, the separation space, the housing, and the stack sections, whereby the exhaust gases flowing through the separation space and into the bottom opening of the housing form a vacuum drawing ambient air into the separation space to mix with and cool the exhaust gases flowing through the channel and into and through the continuous hollow column for cooling and exhaustion from the upper end of the continuous hollow column. As described previously, each exhaust stack section is made of metal and has an outer surface that is grooved, serrated, ribbed, fluted/scalloped, or notched to increase the outer circumferential surface area of each exhaust stack section to displace heat.

In a further main embodiment, the exhaust system is the same as that described above, except: (i) the housing lacks a hanger bracket and instead the lowermost stack section has a hanger bracket attached thereto, which is fixedly secured to a curved rigid metal connector tube; and (ii) the stack sections may be made from metal or plastic, including a low thermal conduction plastic, such as polycarbonate. The curved connector tube attached to this lowermost stack section is inserted into and positioned through the housing on the stand so that the connector tube protrudes through the bottom of the housing, while the housing holds the remainder of the stack section in place in the same manner described above for how the housing holds the lowermost stack section. Once positioned and in held in place, further stack sections are stacked on to make the continuous vertical exhaust column. In this embodiment, the hanger bracket is configured so a separation space exists between the end of the connector tube and lowermost stack section. This embodiment also utilizes at least two metal adaptors and a flexible tube and a further rigid tube. One end of a first metal adaptor attaches to the connector tube by way of pin that goes through two holes in the connector tube that are aligned with two holes on opposite walls of the first metal adaptor. The other end of first metal adaptor inserts into and is attached to a long flexible tube by clamp. The other end of the long flexible tube is attached to a second metal adaptor by a second clamp. The other end of the second metal adaptor slides over and attaches to one end of a further rigid pipe by inserting a pin through two holes on opposite walls of the adaptor that align with two holes on opposite walls of the rigid metal pipe. The rigid pipe is then secured to the exhaust tail pipe of an RV by exhaust clamp. In a further alternative embodiment of this design, only one long stack section is utilized.

Figure 6:
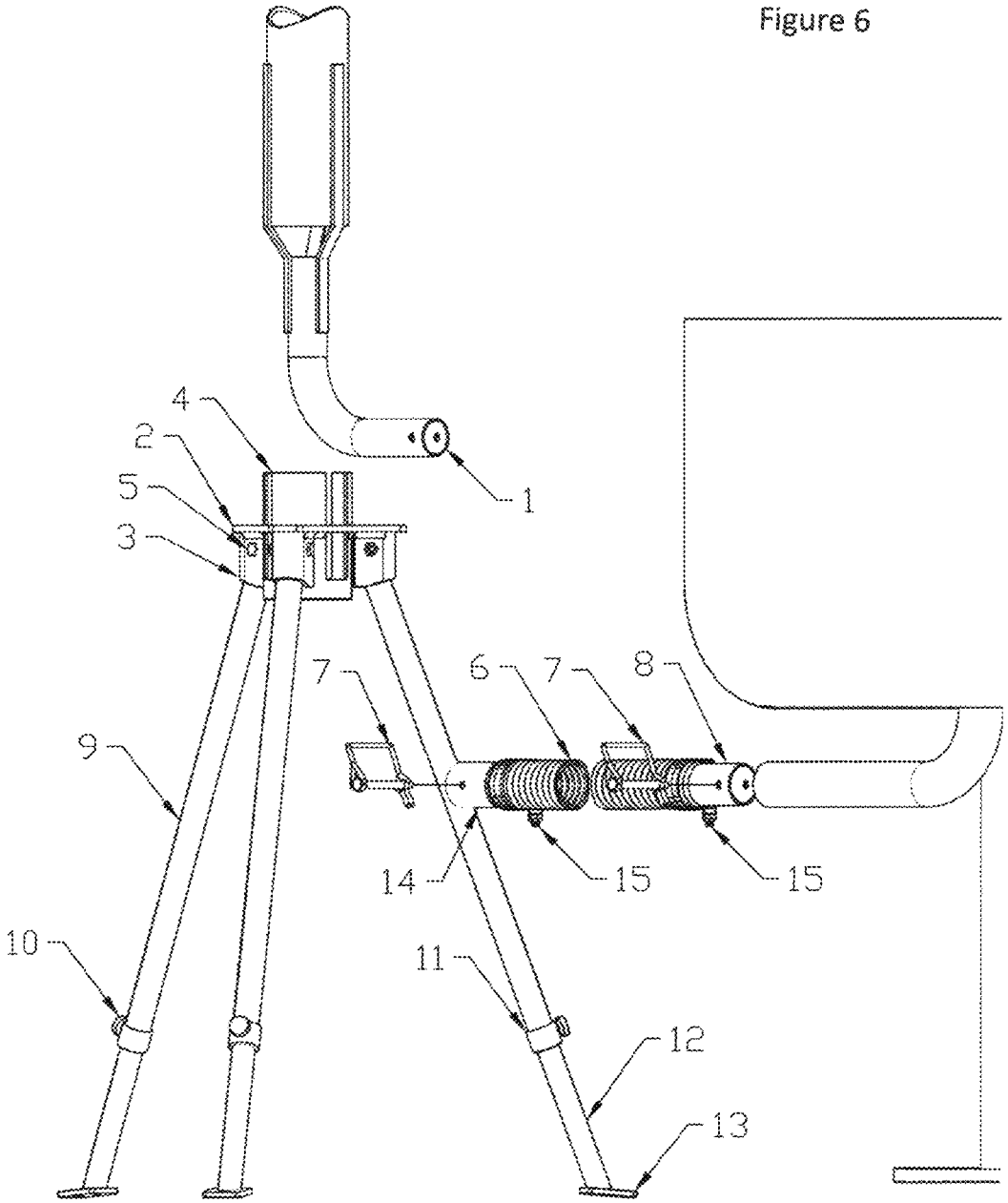
FIG. 6 is a perspective, pictorial representation of an embodiment in which the lowermost stack section is attached to a curved metal connector tube that slides through and is held in place by the tripod housing body and the bent pipe is releasably secured to the exhaust pipe.

Accordingly, in this alternative embodiment, the system comprises: (i) one or more stack sections forming a continuous hollow column having an upper end with an opening and a lower end with an opening; (ii) a metal stand comprising a housing having a top, a bottom, an interior channel connecting an opening on the top to an opening on the bottom, the top opening configured to receive internally the lower end of the continuous hollow column and support the column in an upright vertical position, and a plurality of legs attached to the exterior of the housing; (iii) a hanger bracket fixed to and extending below the lower end of the lowermost stack section; (iv) a metal connector tube having a first end adapted to collect exhaust gases from one or more exhaust pipes on one or more generators or engines, and a second end secured to the hanger bracket and forming a separation space between the second connector tube end and the opening on the end of the lower end of the column; wherein the system is configured so the exhaust gases from the one or more exhaust pipes flow into and through the connector tube and into and through the separation space and into the opening on the lower end of the column in such a manner as to form a vacuum drawing ambient air into the separation space to mix with and cool the exhaust gases as they flow through the continuous hollow column for cooling and exhaustion from the upper end of the continuous hollow column; and each exhaust stack section has an outer surface that is smooth, grooved, serrated, ribbed, fluted/scalloped, or notched to increase the outer circumferential surface area of each exhaust stack section to displace heat. In another version of this embodiment, the stack section is made from one continuous hollow tube (rather than individual stack sections attached together) attached to a curved metal connector tube that slides through and is held in place by the tripod housing body and the bent pipe is releasably secured to the exhaust pipe FIG. 6 illustrates this other embodiment of the portable, free-standing exhaust system in which the housing 4 lacks a hanger bracket and instead the lowest stack section is fixedly secured to a curved connector tube 1, which is then inserted to and held in place by the housing.

This further alternative embodiment also encompasses a method for exhausting gases from one or more generators or engines. This method comprises: attaching a plurality of exhaust stack sections to each other so the stack sections are slidably joined and in fluid communication, one to another, to form a continuous hollow exhaust column having an upper end with an opening and a lower end with an opening; attaching a coupler tube to the lower end of the continuous hollow exhaust column in such a manner as to form a separation space between the coupler tube and the opening on the lower end of the continuous hollow exhaust column; attaching the continuous hollow exhaust column to a metal stand having a housing with a top, a bottom, an interior channel connecting an opening on the top to an opening on the bottom, and three or more legs attached to the exterior of the housing that support the housing in an upright vertical position, wherein the lower end of the continuous hollow exhaust column having the coupler tube attached thereto is inserted into the top opening of the housing and slid through the channel and extends from the bottom opening of the housing and the remainder of the continuous hollow exhaust column is supported by the housing in an upright vertical position; attaching a metal connector tube to other end of the coupler tube; attaching the other end of the metal connector tube to an exhaust pipe from one or more generators or engines; and venting exhaust gases from the exhaust pipe through the connector tube, the coupler tube, the separation space, the housing, and the stack sections, whereby the exhaust gases flowing through the separation space and into the bottom opening of the continuous hollow exhaust column form a vacuum drawing ambient air into the separation space to mix with and cool the exhaust gases flowing through the continuous hollow column for cooling and exhaustion from the upper end of the continuous hollow column. In this embodiment, the exhaust stack sections are made of low thermal conduction plastic or metal, including the metals previously described above. In another version of this embodiment, each exhaust stack section is made of plastic or metal and has an outer surface that is grooved, serrated, ribbed, fluted/scalloped, or notched to increase the outer circumferential surface area of each exhaust stack section to displace heat.

Any reference cited herein is hereby incorporated by reference into the application, whether specifically incorporated or not.

Having now generally described the above-noted embodiments of the application, the same will be more readily understood through reference to the following materials, methods, and examples which are provided by way of illustration, and are not intended to be limiting, unless otherwise specified.

EXAMPLES

The following methods and materials are used in various forms of the Examples that follow as well as in carrying out certain embodiments of the disclosure.

Example 1

The following example illustrates an embodiment wherein the portable, free-standing exhaust system is used with a portable generator. The portable generator exhaust system uses a 1.75 in. outer diameter (OD)×22 in. pipe, bent at 90°, as a connector tube (see for example, FIGS. 1-2, item 14), which is fitted with 2.5 in. flared nipple (see for example FIGS. 1-3, item 17) on one end and the other end of the pipe is inserted into the hanger bracket (see for example FIGS. 1-3, item 8) and secured with a ¼ in.×3 in. pin (see for example FIGS. 1-3, item 7). The hanger bracket is a 0.67 in. formed metal bracket that holds the exhaust connector tube approximately 1.0 in. from the housing/aluminum body tripod body (see for example FIGS. 1-3, item 4) to create a 1.0 in. separation space. This allows the exhaust exiting the connector tube to create a vacuum and suck in cool air around the hanger bracket causing it to mix with the hot exhaust as it is forced through the tripod body. The hanger bracket is secured to the tripod body with three 3⁄16 in.×5⁄8 in. (see for example FIGS. 1-3, item 6) aluminum pop rivets. The tripod body (see for example FIGS. 1-3, item 4) is a tube that is approximately 3 in. inside diameter (ID) by 3.5 in. tall with three ⅛ in.×2.5 in. formed aluminum folding leg pockets (see for example FIGS. 1-3, item 3) with 17⁄64" in. through holes to fasten each collapsible leg (see for example FIGS. 1-3, item 9) in place with a ¼-20×1.5 in. bolt (see for example FIGS. 1-3, item 5) and secured with a ¼-20 lock nut. Each leg pocket is welded to the tripod body. A stack section is a 3 in.×0.74 in. wall serrated aluminum pipe section (see for example FIGS. 1-3, item 1). The lowermost stack section (i.e., first stack section to form the column) slides into the tripod body and rests on the three pop rivets protruding into the tripod body used to fasten the hanger bracket. One end of each exhaust stack section is fitted with an internal sleeve (see for example FIGS. 1-3, item 2) that acts as a coupler to hold the next exhaust stack section (i.e., the sleeve slides inside the next adjoining stack section). Each stack section is a serrated aluminum tube, which is used because it is strong, light weight, has low heat retention and is non-combustible. Each stack section has a serrated outside/exterior surface that provides a larger surface area to displace heat faster, so the stack section does not reach temperatures that can burn people or property. Each stack section is fitted with sleeves allowing the sections to slip together to make a stack (i.e., the vertical continuous exhaust column) tall enough to carry gasses up and over the recreation and/or living area; yet each section remains compact enough for easy transport or storage. The tripod body and stack assembly (i.e., vertical continuous exhaust column) are supported by three 1 in. OD aluminum tubes that form the upper leg sections (see for example FIGS. 1-3, item 9) of the collapsible legs each having a welded aluminum reinforcement collar (see for example FIGS. 1-3, item 11), threaded to receive ¼-20×⅜ in. thumb screws (see for example FIGS. 1-3, item 10) to secure a lower leg section (see for example FIGS. 1-3, item 12), which lower leg section is a ⅞ in. aluminum tube that slides inside the upper leg tube to offer adjustability on uneven terrain and also offer height adjustment to raise the top of the stack over people, roofs, tents, etc. The lower leg sections have feet (FIGS. 1-2, item 13) welded to the bottom for stability. The feet are equipped with holes for staking the legs in place to prevent the stack from being inadvertently knocked over. Alternatively, on hard surfaces, such as asphalt or concrete, weighted bags can be attached to the tripod to stabilize it and keep it from being knocked over.

Example 2

The following example illustrates an embodiment wherein the portable, free-standing exhaust system is used with a recreational vehicle (RV). The design for the RV application reflects the same construction as the portable generator model, except it has taller legs and instead of the 90° bent pipe as the connector tube it utilizes one or more metal support tubes and one or more metal adaptors that further attach to a flexible aluminum pipe and to an exhaust pipe/muffler. The 4.0 in. metal adaptor pipe (item 17, FIG. 5) has an approximate inside diameter (ID) of 1.5 in. One end of this metal pipe slides over the generator exhaust pipe or muffler and has slots cut in the end for clamping it in place with exhaust clamp (item 18, FIG. 5). The other end of metal pipe (item 17, FIG. 5) has a 1.625 in. outside diameter (OD) with a through hole in the side to accept a ¼ in.×3 in. locking pin (item 7, FIG. 5) and a 4 in. metal support pipe with a 1.75 in. (OD) (item 14, FIG. 5) with a through hole in one end and the other end of which slides inside each end of a flexible aluminum pipe (item 16 in FIG. 5) (1.75 in. ID and 2.0 in. OD made of 0.019 in thick aluminum; used for its strength, light weight, low heat retention, and non-combustible properties) and then clamped in place with two 0.75 in. wide band clamps (item 15, FIG. 5). One end of the flexible aluminum pipe is fitted with 1.75 in. metal pipe and slides over metal support pipe (item 17, FIG. 5) and is secured with ¼ in. pin (item 7) the other end of the flexible pipe is secured with 1.75 in. metal support pipe that is in turn slid into the hanger bracket (item 8) and secured thereto with ¼ in. pin (item 7), which suspended the flexible pipe outlet 1.5 in. from the tripod body offering the same cooling effect as the portable generator model by also drawing cool air into the stack.

The unique design of the exhaust system of the disclosure and as illustrated for instance in the examples above provide a safe and efficient removal of harmful gases and helps to abate annoying noise associated with generators. Since it is built of light-weight, non-combustible material, such as aluminum, it is ideal for both occasional use at home and repeated use while camping or tail-gating. It is easy to assemble, and at around 13 pounds, is easy to carry. The exhaust systems of the disclosure address the unmet needs of larger RVs and campers with slide-outs and obstructions by reducing the risks posed by carbon monoxide as the system carries harmful exhaust and heat above the indoor and outdoor living areas.

A number of embodiments have been described but a person of skill understands that still other embodiments are encompassed by this disclosure. It will be appreciated by those skilled in the art that changes could be made to the embodiments described above without departing from the broad inventive concepts thereof. It is understood, therefore, that this disclosure and the inventive concepts are not limited to the particular embodiments disclosed, but are intended to cover modifications within the spirit and scope of the inventive concepts including as defined in the appended claims. Accordingly, the foregoing description of various embodiments does not necessarily imply exclusion. For example, "some" embodiments or "other" embodiments may include all or part of "some", "other," "further," and "certain" embodiments within the scope of this invention.

What is claimed:

1. A system for exhausting gases from one or more generators or engines, comprising:

a plurality of metal exhaust stack sections, slidably joined and in fluid communication, one to another, to form a continuous hollow column having an upper end with an opening and a lower end with an opening;

a metal stand comprising a housing having a top, a bottom, an interior channel connecting an opening on the top to an opening on the bottom, the top opening configured to receive internally the lower end of the continuous hollow column and support the column in an upright vertical position, and three or more legs attached to the exterior of the housing that support the housing;

a hanger bracket fixed to and extending below the bottom opening of the housing; and a metal connector tube having a first end adapted to collect exhaust gases from one or more exhaust pipes on the one or more generators or engines, and a second end releasably secured to the hanger bracket and forming a separation space between the second end and the opening on the bottom of the housing;

wherein the system is configured so the exhaust gases from the one or more exhaust pipes flow into and through the connector tube and into and through the separation space and into the bottom opening of the housing in such a manner as to form a vacuum drawing ambient air into the separation space to mix with and cool the exhaust gases flowing through the channel and into and through the continuous hollow column for cooling and exhaustion from the upper end of the continuous hollow column; and each metal exhaust stack section has an outer surface that is grooved, serrated, ribbed, fluted/scalloped, or notched to increase the outer circumferential surface area of each exhaust stack section to displace heat.

2. The system of claim 1, wherein the system is portable and free-standing, and each leg is configured to be adjustable to be raised or lowered to a desired height and is connected to the housing by a way of a hinge so the leg is collapsible.

3. The system of claim 2, further comprising feet fixed to the end of each leg, which feet are configured to be releasably anchored to the ground.

4. The system of claim 3, wherein each metal exhaust stack section, the housing and the legs are made from aluminum.

5. The system of claim 4, wherein the housing has a tripod body made from a cylindrical aluminum tube.

6. The system of claim 1, wherein each metal exhaust stack section has a top, a bottom, and a fitted sleeve extending from the top configured to slide into the bottom of another metal exhaust stack section positioned above it to form the continuous hollow column.

7. The system of claim 1, wherein each metal exhaust stack surface is a ribbed cylindrical aluminum tube.

8. The system of claim 1, wherein the separation space between the second connector tube end and the bottom opening is selected from the group consisting of about 0.25, 0.5, 0.75, 1.0, 1.25, 1.5, 1.75, 2.0, and 2.25 inches.

9. The system of claim 1, wherein the one or more generators or engines is a portable generator or an engine attached to a recreational vehicle, camper, motor home, house, or building.

10. The system of claim 1, wherein the first connector tube end is fitted with a flared nipple.

11. The system of claim 1, wherein the first connector tube end is releasably attached to one end of a flexible tube and the other end of the flexible tube is fitted with a flared nipple.

12. The system of claim 1, wherein the first connector tube end is configured to split into two or more ends each adapted to collect exhaust gases from an exhaust pipe.

13. The system of claim 1, wherein the connector tube is chosen from a flexible tube, a straight rigid pipe, an angled or bent rigid pipe, an L-shaped pipe, and a curved rigid pipe, and wherein the connector tube is made from aluminum, galvanized steel, or stainless steel.

14. The system of claim 13, wherein the connector tube is a galvanized stainless steel pipe or an aluminum pipe configured so the first connector tube end is positioned 90° relative to the second connector tube end.

15. The system of claim 1, wherein the first connector tube end attaches directly to the one or more exhaust pipes, or is spaced at a distance from the one or more exhaust pipes, or is configured to engage an adapter that slides over and is clamped onto the one or more exhaust pipes.

16. The system of claim 1, wherein:

each metal exhaust stack section is a cylindrical ribbed aluminum tube, having a top, a bottom, and a fitted sleeve extending from the top configured to slide into the bottom of another exhaust stack section positioned above it;

the housing comprises an aluminum tube tripod body with three adjustable aluminum legs and having a top opening and a bottom opening, the top opening configured to receive internally the lower end of the column and support the column in an upright vertical position; the connector tube is a steel pipe with a 90° bend, the first connector tube end has a flared nipple attached to it, and the second connector tube end is configured to insert into and be secured to the hanger bracket by a pin; and the separation space is about 1.0 inch.

17. The system of claim 1, further comprising: a first metal support tube, a second metal support tube, and a metal adaptor tube; wherein the connector tube is a flexible metal tube, and the first metal support tube releasably attaches at one end to the hanger bracket and releasably attaches at the other end to one end of the flexible metal, and the other end of the flexible metal tube releasably attaches to one end of the second metal support tube and the other end the second metal support tube releasably attaches to a metal adaptor that releasably attaches to the exhaust pipe.

18. A system for exhausting gases from one or more generators or engines, comprising:

one or more stack sections forming a continuous hollow column having an upper end with an opening and a lower end with an opening;

a metal stand comprising a housing having a top, a bottom, an interior channel connecting an opening on the top to an opening on the bottom, the top opening configured to receive internally the lower end of the continuous hollow column and support the column in an upright vertical position, and a plurality of legs attached to the exterior of the housing;

a hanger bracket fixed to and extending below the lower end of the lowermost stack section;

a metal connector tube having a first end adapted to collect exhaust gases from one or more exhaust pipes on one or more generators or engines, and a second end secured to the hanger bracket and forming a separation space between the second end and the opening on the lower end of the column;

wherein the system is configured so the exhaust gases from the one or more exhaust pipes flow into and through the connector tube and into and through the separation space and into the opening on the lower end of the column in such a manner as to form a vacuum drawing ambient air into the separation space to mix with and cool the exhaust gases as they flow through the continuous hollow column for cooling and exhaustion from the upper end of the continuous hollow column; and each exhaust stack section has an outer surface that is smooth, grooved, serrated, ribbed, fluted/scalloped, or notched to increase the outer circumferential surface area of each exhaust stack section to displace heat.

19. A method of exhausting gases from one or more generators or engines, comprising:

attaching a plurality of exhaust stack sections to each other so the stack sections are slidably joined and in fluid communication, one to another, to form a continuous hollow exhaust column having an upper end with an opening and a lower end with an opening;

attaching the continuous hollow exhaust column to a metal stand having a housing with a top, a bottom, an interior channel connecting an opening on the top to an opening on the bottom, and three or more legs attached to the exterior of the housing that support the housing in an upright vertical position, wherein the lower end of the continuous hollow exhaust column is inserted into the top opening of the housing and supported by the housing in an upright vertical position;

attaching a metal connector tube to a hanger bracket fixed to the housing and extending below the bottom opening of the housing in such a manner to form a separation space between the connector tube and the bottom opening of the housing;

attaching the other end of the metal connector tube to an exhaust pipe from one or more generators or engines; and venting exhaust gases from the exhaust pipe into and through the connector tube, the separation space, the housing, and the stack sections, whereby the exhaust gases flowing through the separation space and into the bottom opening of the housing form a vacuum drawing ambient air into the separation space to mix with and cool the exhaust gases flowing through the channel and into and through the continuous hollow column for cooling and exhaustion from the upper end of the continuous hollow column.

20. The method of claim 19, wherein each exhaust stack section is made of metal and has an outer surface that is grooved, serrated, ribbed, fluted/scalloped, or notched to increase the outer circumferential surface area of each exhaust stack section to displace heat.

21. A method of exhausting gases from one or more generators or engines, comprising:

attaching a plurality of exhaust stack sections to each other so the stack sections are slidably joined and in fluid communication, one to another, to form a continuous hollow exhaust column having an upper end with an opening and a lower end with an opening;

attaching a coupler tube to the lower end of the continuous hollow exhaust column in such a manner as to form a separation space between the coupler tube and the opening on the lower end of the continuous hollow exhaust column;

attaching the continuous hollow exhaust column to a metal stand having a housing with a top, a bottom, an interior channel connecting an opening on the top to an opening on the bottom, and three or more legs attached to the exterior of the housing that support the housing in an upright vertical position, wherein the lower end of the continuous hollow exhaust column having the coupler tube attached thereto is inserted into the top opening of the housing and slid through the channel and extends from the bottom opening of the housing and the remainder of the continuous hollow exhaust column is supported by the housing in an upright vertical position;

attaching a metal connector tube to other end of the coupler tube;

attaching the other end of the metal connector tube to an exhaust pipe from one or more generators or engines; and venting exhaust gases from the exhaust pipe into and through the connector tube, the coupler tube, the separation space, the housing, and the stack sections, whereby the exhaust gases flowing through the separation space and into the bottom opening of the continuous hollow exhaust column form a vacuum drawing ambient air into the separation space to mix with and cool the exhaust gases flowing through the continuous hollow column for cooling and exhaustion from the upper end of the continuous hollow column.

22. The method of claim 21, wherein each exhaust stack section is made of metal or plastic and has an outer surface that is grooved, serrated, ribbed, fluted/scalloped, or notched to increase the outer circumferential surface area of each exhaust stack section to displace heat.

* * * * *